US008403413B2

(12) United States Patent
Scott

(10) Patent No.: US 8,403,413 B2
(45) Date of Patent: Mar. 26, 2013

(54) MULTI-MODE PORTABLE BOOSTER SEAT

(76) Inventor: Audrey Jean Scott, Elk City, OK (US)

( * ) Notice: Subject to any disclaimer, the term of this patent is extended or adjusted under 35 U.S.C. 154(b) by 218 days.

(21) Appl. No.: 12/815,613

(22) Filed: Jun. 15, 2010

(65) Prior Publication Data

US 2011/0304181 A1 Dec. 15, 2011

(51) Int. Cl.
*A47D 1/10* (2006.01)

(52) U.S. Cl. ..... 297/250.1; 297/467

(58) Field of Classification Search ..... 297/188.01, 297/188.08, 188.13, 219.12, 250.1, 461, 297/462, 467
See application file for complete search history.

(56) References Cited

U.S. PATENT DOCUMENTS 3,763,972 A * 10/1973 Karzmar ..... 190/8
4,291,915 A * 9/1981 Cox ..... 190/8
4,318,502 A * 3/1982 Lowe et al. ..... 224/153
4,871,210 A * 10/1989 Alexander et al. ..... 297/485
5,580,125 A * 12/1996 Alger ..... 297/250.1
6,079,599 A * 6/2000 Nordstrom et al. ..... 224/153
6,390,345 B1 * 5/2002 Brown et al. ..... 224/578
6,692,072 B2 * 2/2004 Nelson et al. ..... 297/250.1
6,929,325 B1 * 8/2005 Goelo ..... 297/219.1
7,571,961 B2 * 8/2009 Gold et al. ..... 297/255
7,591,510 B1 * 9/2009 Giampavolo ..... 297/256.17
2005/0077329 A1 * 4/2005 Sconzo ..... 224/153
2005/0146181 A1 * 7/2005 Donoghue ..... 297/250.1
2007/0046084 A1 * 3/2007 Leach ..... 297/250.1
2008/0302840 A1 * 12/2008 Missick ..... 224/155

* cited by examiner

*Primary Examiner* — David Dunn
*Assistant Examiner* — Philip Gabler
(74) *Attorney, Agent, or Firm* — Mark Young, PA

(57) ABSTRACT

A booster seat may be conveniently carried over one's shoulder using a shoulder strap or worn as a backpack using a pair of parallel straps. The shoulder strap is convertible from a shoulder strap into a leash with a handle. A foam core and padded backpack-style shoulder straps, making it comfortable to carry and use. A three-point seatbelt includes a lap belt and pelvic strap, making it extremely safe to use. The seatbelt prevents a child from slipping off the booster seat. The booster seat also includes non-slip pads which prevent the booster seat from sliding off a chair, bench or booth. In an embodiment with thick non-slip pads, the pads maintain a space between the back panel and a backpack wearer's back, increasing breathability and comfort.

13 Claims, 10 Drawing Sheets

MULTI-MODE PORTABLE BOOSTER SEAT

FIELD OF THE INVENTION

This invention relates generally to child booster seats, and, more particularly, to a portable seat cushion, with adjustable carrying and harness straps, configured for comfortably and safely elevating a child seated in various seating devices.

BACKGROUND

Young children frequently require elevated seating to reach a table or facilitate viewing. For example, a booster seat may be placed upon an ordinary chair to help a child comfortably reach a dinner table. While many dining establishments offer high chairs and fewer offer booster seats, these seating devices tend to be uncomfortable and unsanitary. High chairs can be inconvenient to use, especially with booths where the child is left in an aisle exposed to heavy patron and server traffic. Occasionally, high chairs and booster seats are unavailable at an establishment, because the establishment either does not have any or does not have sufficient high chairs or booster seats.

When booster seats are available at an establishment, they typically have several shortcomings. First, they tend to be unitary structures comprised of blow-molded plastic, without any cushion. They are uncomfortable. Second, the plastic tends to retain residue, dirt and grime from prior use. Thus, they are unsanitary. Third, the plastic bottom tends to slide on chairs and booths, especially those made of leather, vinyl or the like. The lack of traction creates a risk of slipping off a booth or chair. Fourth, the booster seats tend to lack safety belts. A restless child may easily slide off the booster seat.

A need exists for a portable booster seat that may be conveniently carried to various establishments. The seat should be comfortable to carry and use. The booster seat should be safe to use, providing means to prevent a child from slipping off the booster seat as well as means to prevent the booster seat from sliding off a chair, bench or booth. The seat should also be versatile, serving needs beyond a sitting apparatus to maximize utility.

The invention is directed to overcoming one or more of the problems and solving one or more of the needs as set forth above.

SUMMARY OF THE INVENTION

To solve one or more of the problems set forth above, in an exemplary implementation of the invention, a booster seat includes a removable body-supporting cushion; a housing that defines a compartment for containing the removable body-supporting cushion, the housing includes a front panel, a back panel and four side panels connecting the front panel to the back panel, said four side panels includes a top panel, a bottom panel, a left side panel and a right side panel, said housing having an exterior surface, said front panel, back panel, and four side panels is comprised of pliable material; an opening with a releasable closure along at least one of said four side panels, allowing access to the compartment; a pair of parallel adjustable shoulder straps configured for backpack-style carrying, each adjustable strap of the pair of parallel adjustable straps having a top end and a bottom end, the top end is attached to the back panel adjacent to the top panel and the bottom end is attached to the back panel adjacent to the bottom panel, one adjustable strap defining a loop through which one arm and one shoulder may extend, the other adjustable strap defining a loop through which another arm and another shoulder may extend. The body-supporting cushion may be a polyurethane foam core, which may include a waterproof cover over the polyurethane foam core or an absorbent cover over the polyurethane foam core.

Each adjustable strap of the pair of parallel adjustable straps may include an upper padded shoulder strap portion and a lower webbing portion. A releasable buckle releasably joins the upper padded shoulder strap portion to the lower webbing portion. The releasable buckles are length adjustable buckles. An adjustable segment of the lower webbing portion of each adjustable strap is threaded through and retained by the length adjustable buckle. The adjustable segments may comprise ladder locks.

The parallel adjustable shoulder straps are adjustable in length to extend across the bottom of a seat of a seating apparatus while the booster seat rests on top of the seat. Each releasable buckle is configured to enable each upper padded shoulder strap portion to detach from each lower webbing portion, allowing reattachment under the bottom of the seat using the releasable buckle.

A removable reconfigurable adjustable length carrying strap is provided. The strap has a first end and a second end. The first end is releasably coupled to one of the four side panels of the housing. The second end is releasably coupled to an opposite side of the four side panels of the housing. A first releasable coupling is attached to the first end. A second releasable coupling is attached to the second end. The second end includes an adjustable length looped portion. The first end is releasably coupled, using the first releasable coupling, to one of the four side panels of the housing. The second end is releasably coupled, using the second releasable coupling, to an opposite side panel of the four side panels of the housing. An intermediate coupling is attached to the strap between the first end and the second end. The first releasable coupling is attachable to the intermediate coupling to form a loop handle at the first end of the strap. A separate leash coupling is attached to the housing at the top panel. The second end of the removable adjustable length carrying strap is attachable to the leash coupling using the second releasable coupling.

A three-point seat belt is also provided. The three point seat belt includes a T-shaped arrangement of three seat belt straps disposed on the front panel of the housing. Each of two of said three seat belt straps have a medial end and an opposite lateral end. One of the three seat belt straps has a superior end and an inferior end. The three-point seat belt further includes a seat belt buckle. Each medial end and the superior end of the three seat belt straps are attached to the seat belt buckle. The lateral ends and inferior end of the seat belt straps are releasably coupled to the housing. A first medial end of the first seat belt strap and the second medial end of the second seat belt strap and the superior end of the third seat belt strap are attached to the seat belt buckle. The first seat belt strap extends from the seat belt buckle to a first side edge of the front panel. The second seat belt strap extends from the seat belt buckle to a second side edge of the front panel opposite the first side edge. The third seat belt strap extends from the seat belt buckle in a direction perpendicular to the to a bottom side edge of the front panel. The first and second seat belt straps define a lap belt and the third seat belt strap defining a pelvic belt. The belt buckle is a T-shaped joint having a first attachment slot for attaching the medial end of the first strap, a second attachment slot opposite the first attachment slot for attaching the medial end of the second strap, and a third attachment slot for attaching the superior end of third strap.

The back panel includes a pair of spaced apart parallel non-slip sheets. Each parallel non-slip sheet is aligned with one of the parallel adjustable shoulder straps and is wider than the aligned shoulder strap. In an exemplary embodiment, the non-slip sheet is about 0.125 to 0.250 inches thick.

Thus, the invention provides a booster seat that may be conveniently carried to various establishments. It may be carried over one's shoulder or worn as a backpack. A shoulder strap is provided, which is convertible from a shoulder strap into a leash with a handle. The seat includes a foam core and padded backpack-style shoulder straps, making it comfortable to carry and use. The booster seat includes a three-point seatbelt including a lap belt and pelvic strap, making it extremely safe to use. The seatbelt prevents a child from slipping off the booster seat. The booster seat also includes non-slip pads which prevent the booster seat from sliding off a chair, bench or booth. In an embodiment with thick non-slip pads, the pads maintain a space between the back panel and a backpack wearer's back, increasing breathability and comfort. The seat is versatile, serving needs beyond a sitting apparatus to maximize utility.

BRIEF DESCRIPTION OF THE DRAWINGS

The foregoing and other aspects, objects, features and advantages of the invention will become better understood with reference to the following description, appended claims, and accompanying drawings, where:

Figure 2:
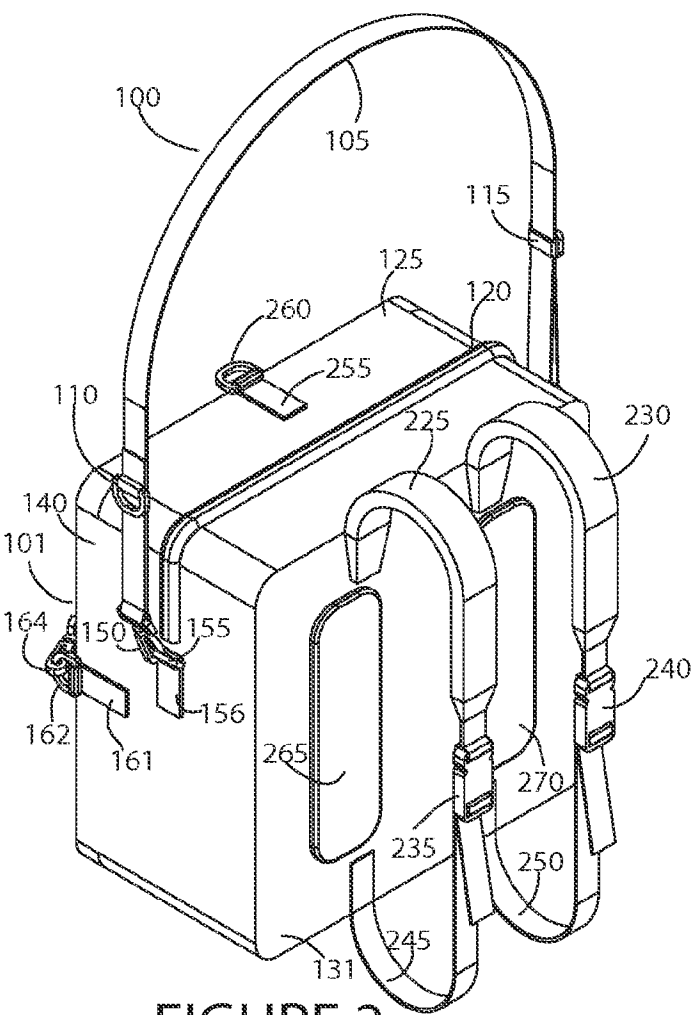
FIG. 2 is a back-top perspective view of an exemplary booster seat according to principles of the invention.
Figure 1:
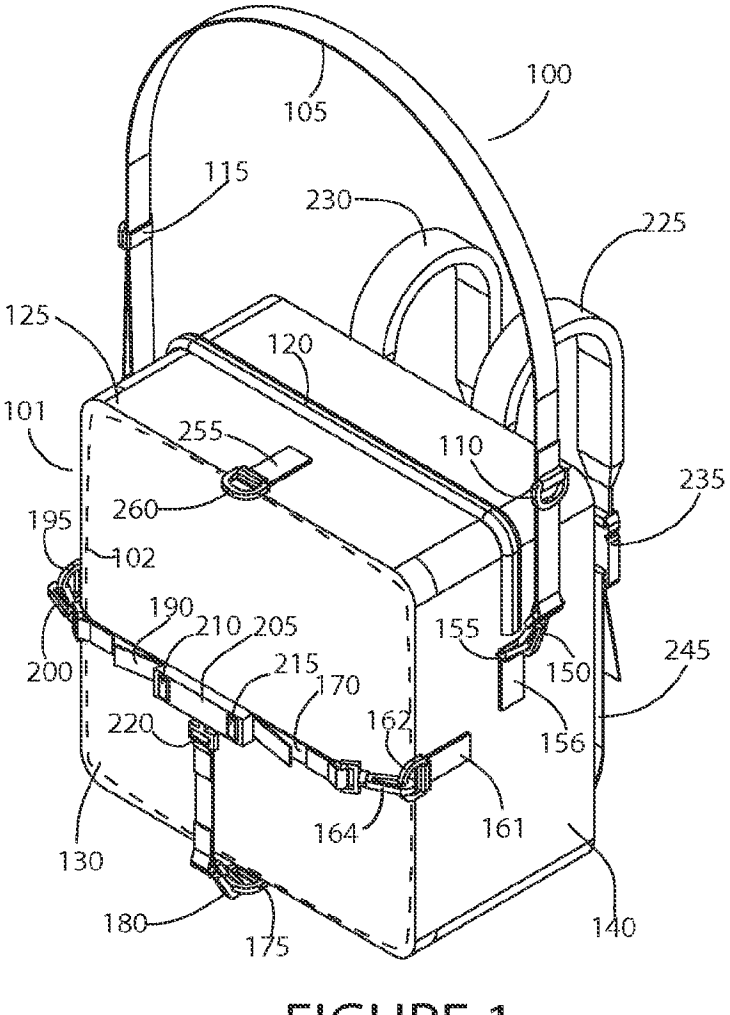
FIG. 1 is a front-top perspective view of an exemplary booster seat according to principles of the invention.
Figure 4:
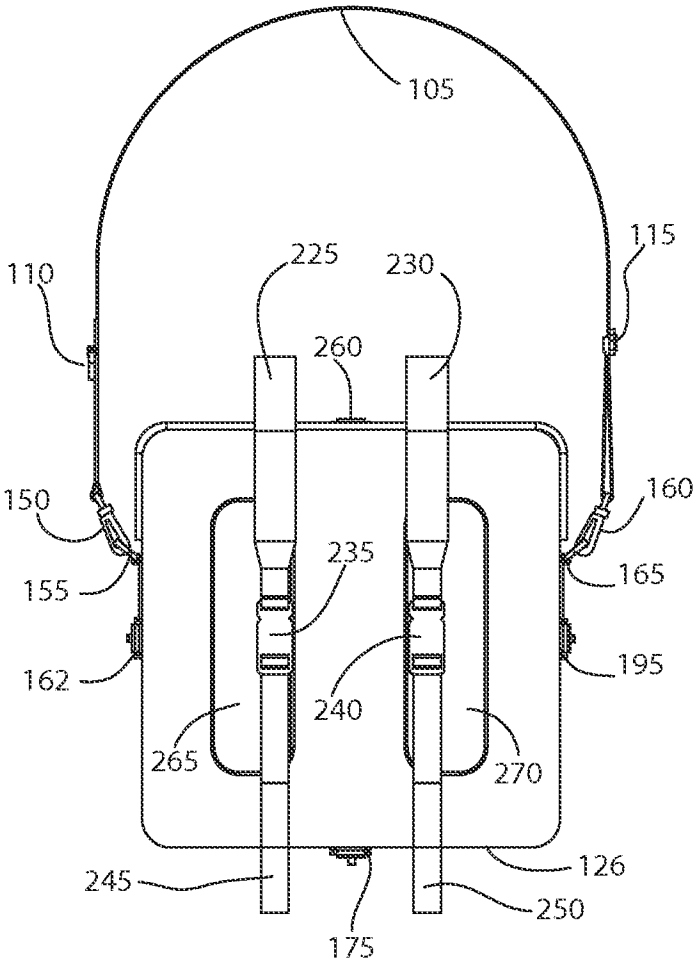
FIG. 4 is a back view of an exemplary booster seat according to principles of the invention.
Figure 3:
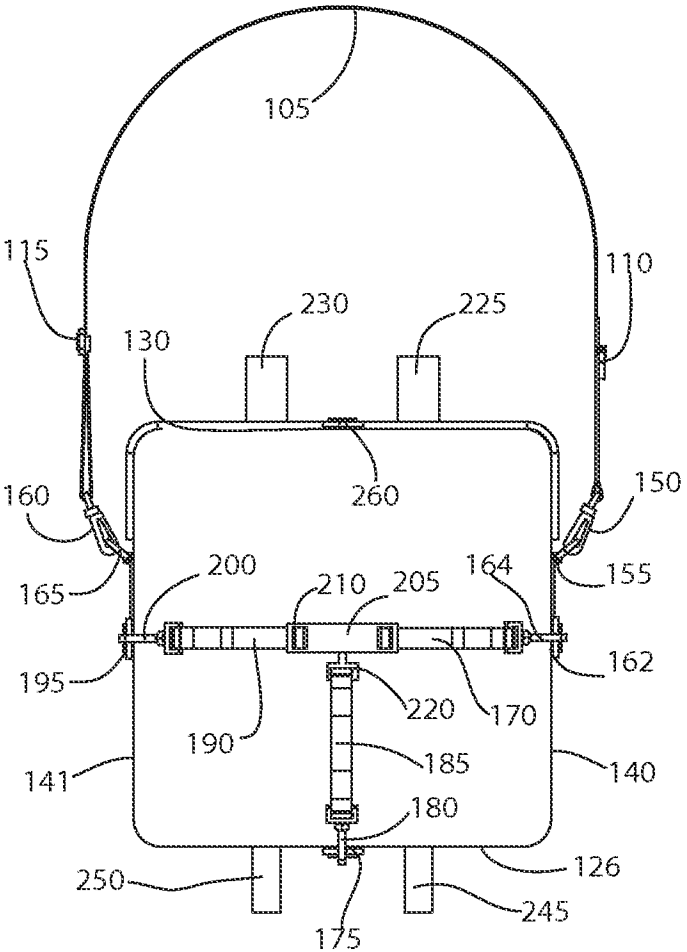
FIG. 3 is a front view of an exemplary booster seat according to principles of the invention.
Figure 6:
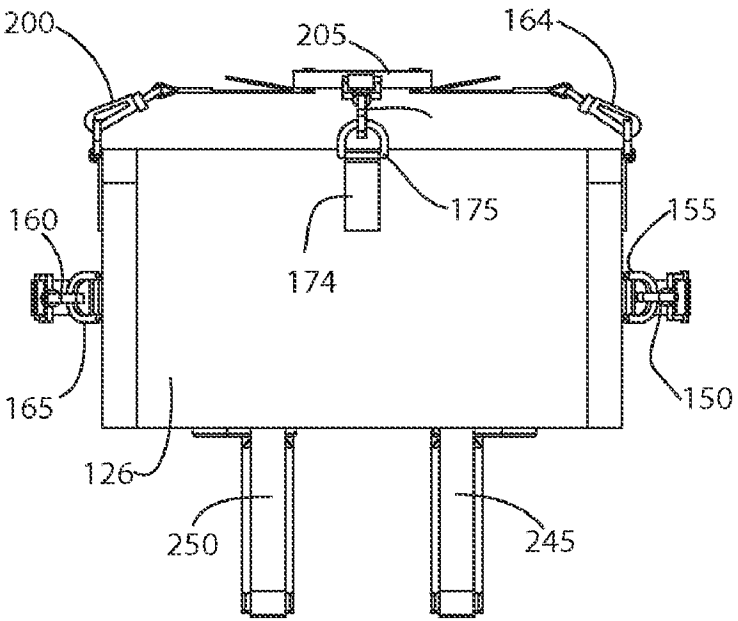
FIG. 6 is a bottom view of an exemplary booster seat according to principles of the invention.
Figure 5:
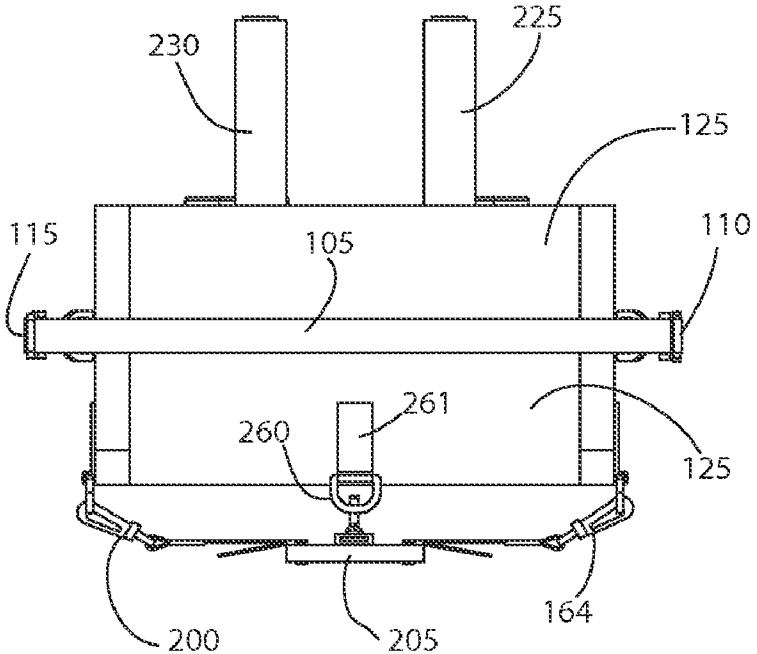
FIG. 5 is a plan view of an exemplary booster seat according to principles of the invention.
Figure 8:
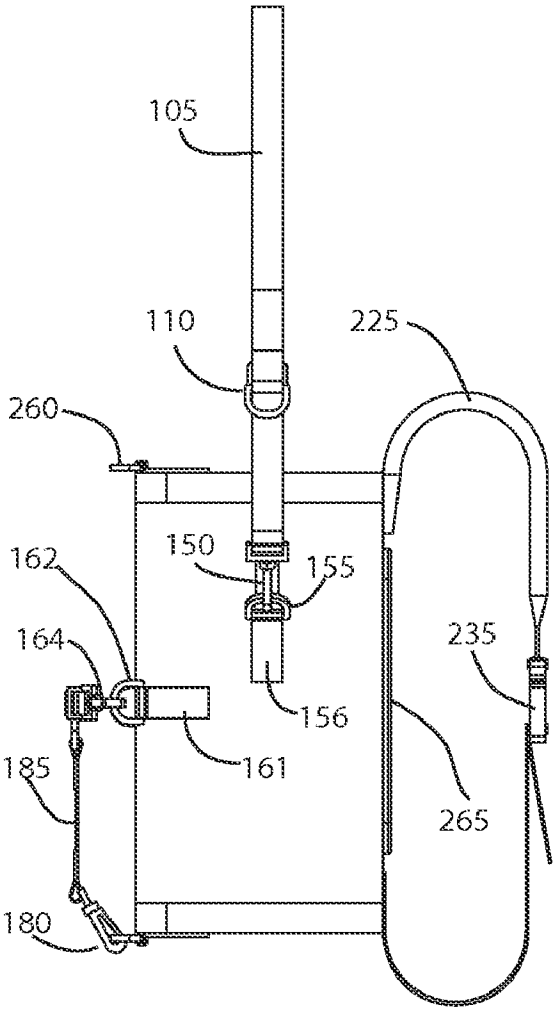
FIG. 8 is a second side perspective view of an exemplary booster seat according to principles of the invention.
Figure 7:
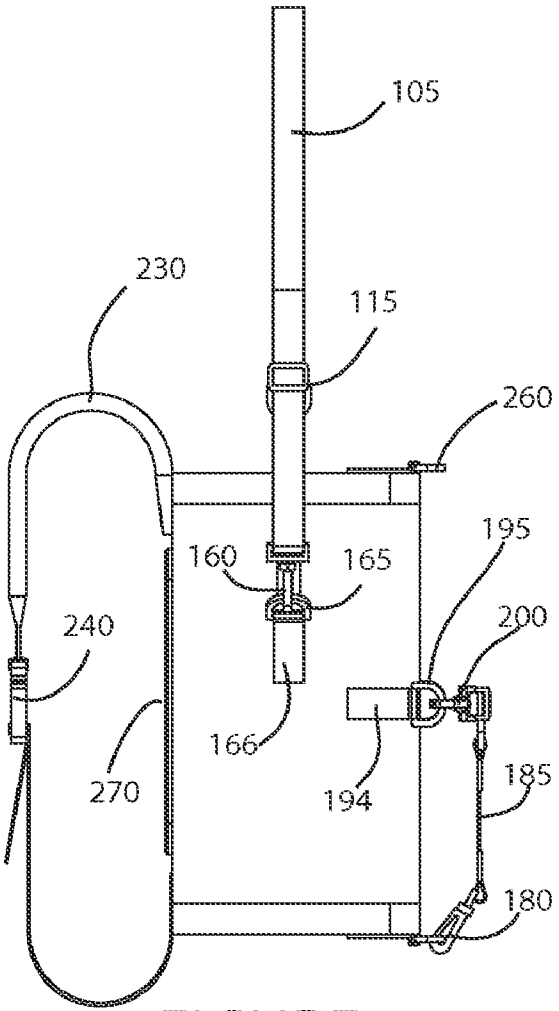
FIG. 7 is a first side view of an exemplary booster seat according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or to the components, configuration, shapes, relative sizes, ornamental aspects or proportions shown in the figures.

DETAILED DESCRIPTION

Referring to FIGS. 1 through 8, various views of an exemplary booster seat 100 according to principles of the invention are provided. The booster seat 100 comprises a housing 101 that defines a compartment for containing a removable cushion. The exterior of the housing includes attachment hardware, straps and accessories to enable the functionality described herein.

The housing 101 is a bag-like enclosure comprised of a pliable material, such as textiles of natural and/or synthetic fibers, elastomeric materials suitable for garment or pillowcase construction, and/or natural or synthetic leather materials. In a preferred embodiment, the housing 101 is a six-sided prism comprising a four-sided polygonal front panel 130, a translated copy of the front panel as a back panel 131, and four side panels (i.e., right 140 and left 141 side panels as well as top 125 and bottom 126 panels) joining the front panel 130 to the back panel 131.

Figure 18:
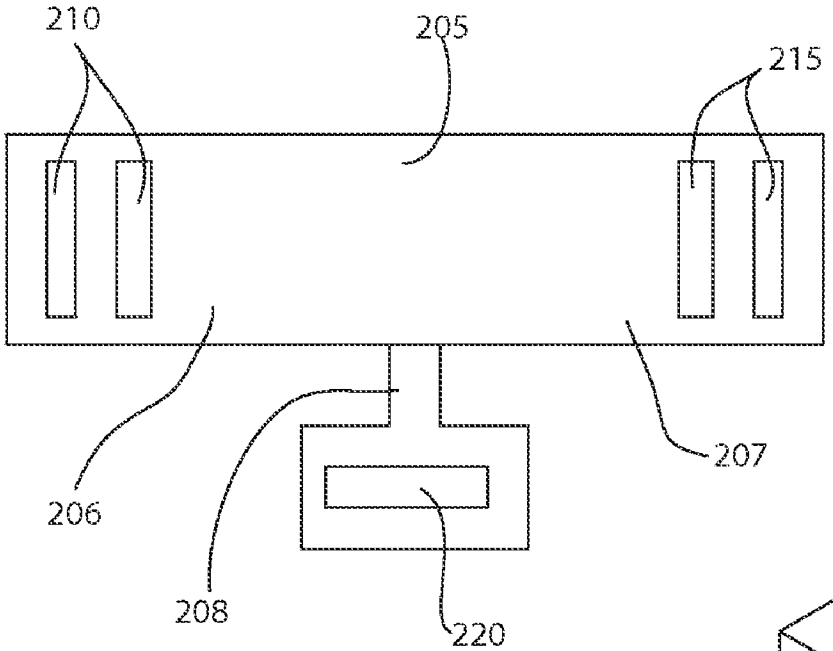
FIG. 18 is a front view of a three-point yoke for an exemplary booster seat according to principles of the invention.
Figure 19:
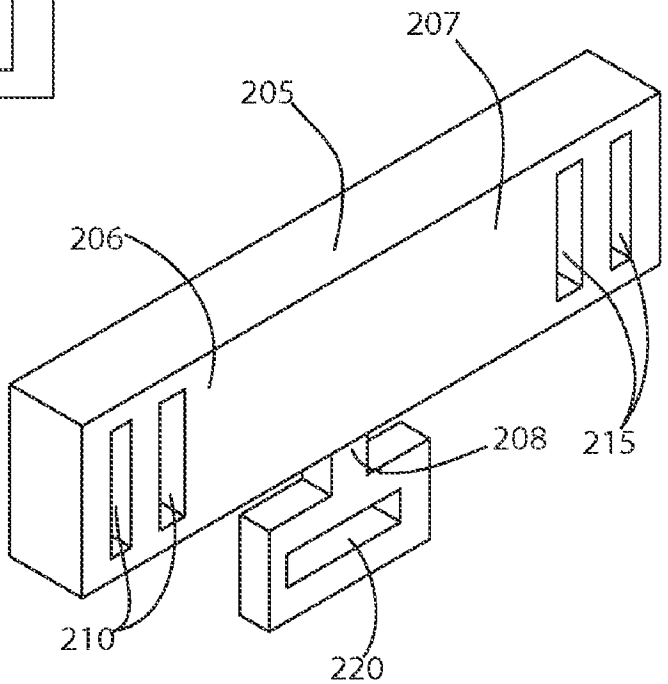
FIG. 19 is a front-top perspective view of a three-point yoke for an exemplary booster seat according to principles of the invention.

The front panel 130 includes a three-point seat belt, meaning that the seat belt attaches to the housing 101 at three points. Straps 170, 185, 190 attach to a T-shaped joint 205, referred to as a three-point buckle. As shown in FIGS. 18 and 19, the three-point buckle 205 includes a plurality of slots for engaging webbing. A first pair of slots 210 engages webbing strap 190. A second pair of slots 215 engages webbing strap 170. A third slot 220 engages webbing strap 185. The straps may be stitched to the three-point buckle 205 or attached using other types of attachments. The three point buckle includes a left arm 206, right arm 207 and vertical arm 208.

Figure 12:
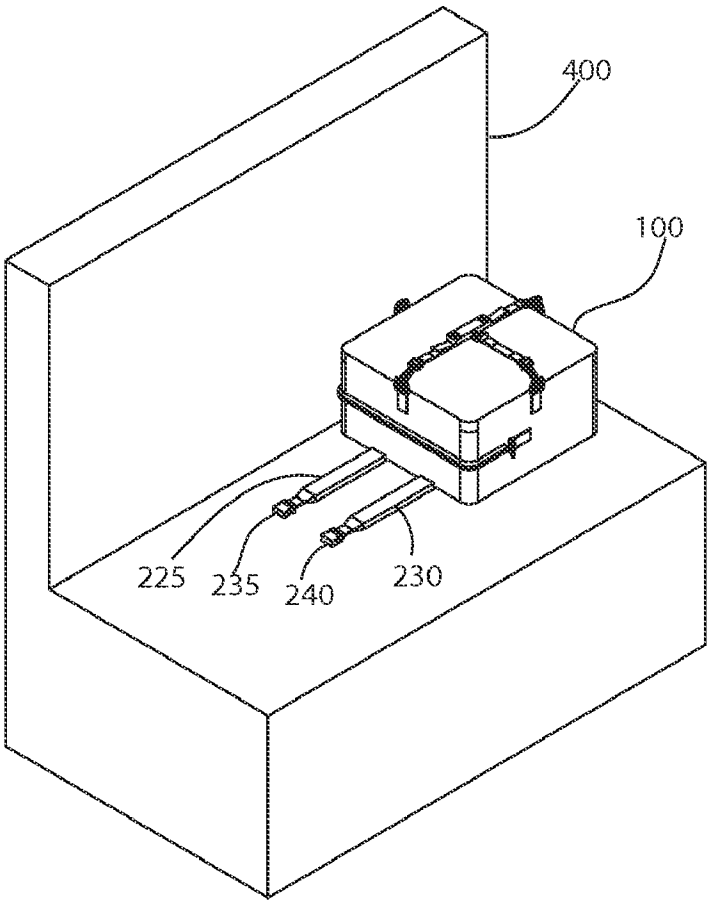
FIG. 12 is a first top perspective view of an exemplary booster seat on a bench-style seating apparatus according to principles of the invention.
Figure 15:
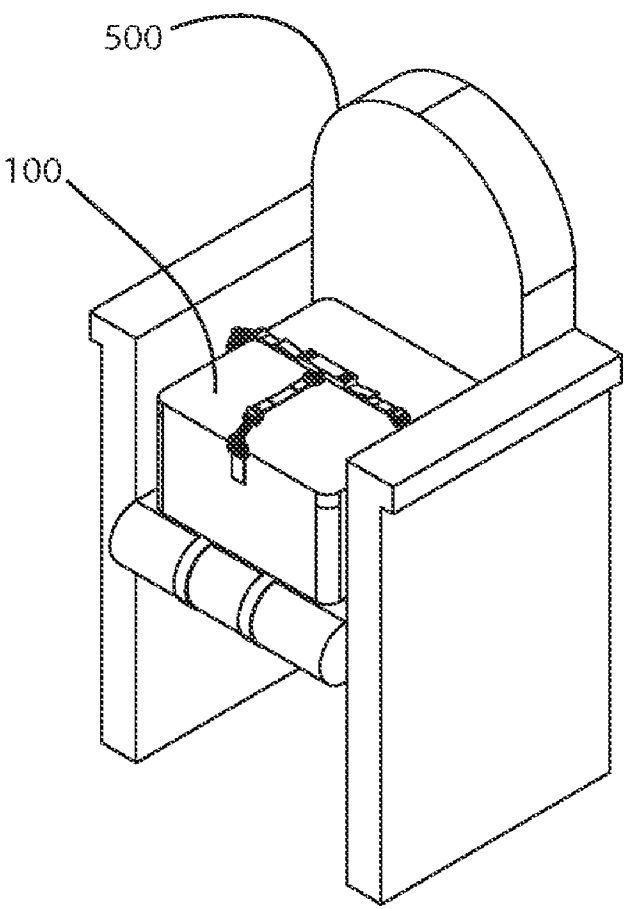
FIG. 15 is a second top perspective view of an exemplary booster seat on a theater-style seating apparatus according to principles of the invention.
Figure 14:
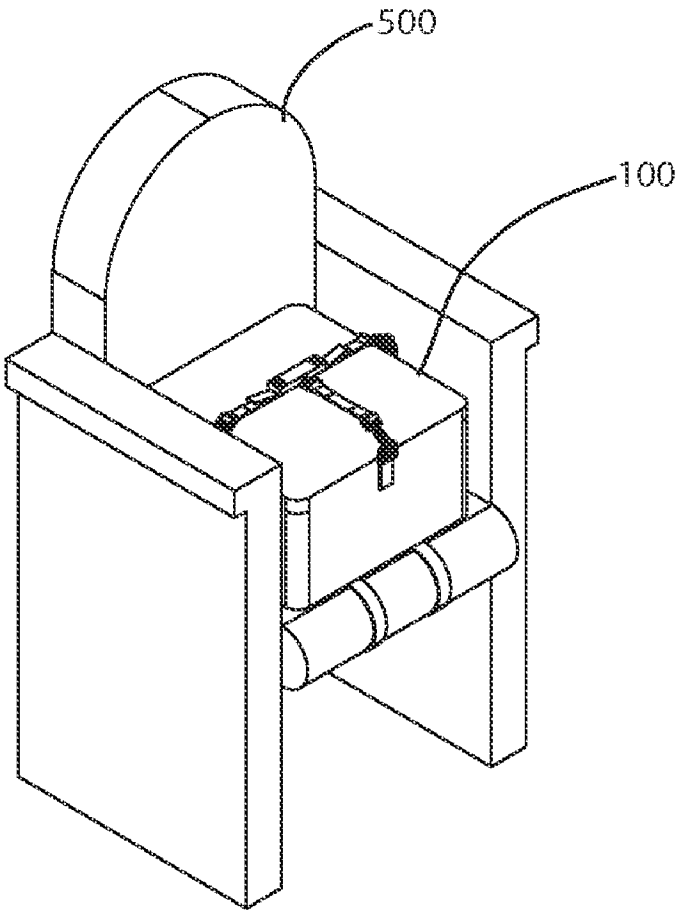
FIG. 14 is a first top perspective view of an exemplary booster seat on a theater-style seating apparatus according to principles of the invention.
Figure 17:
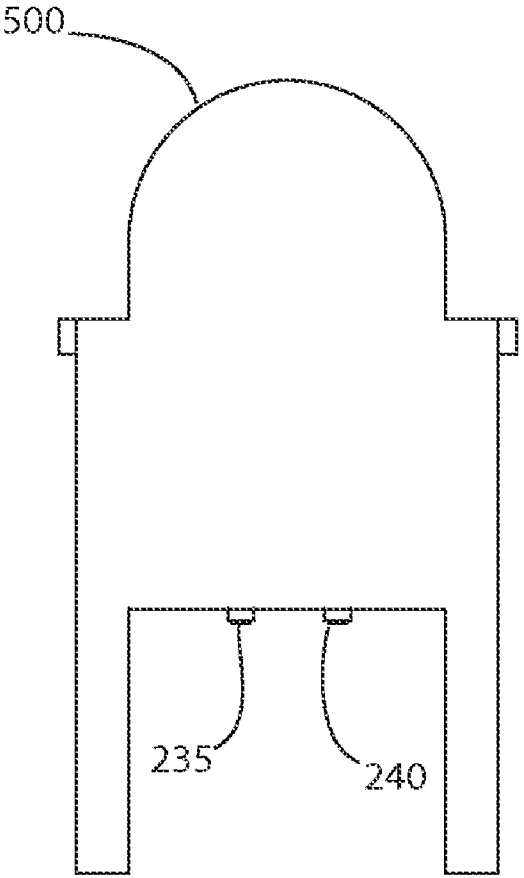
FIG. 17 is a back view of an exemplary booster seat on a theater-style seating apparatus according to principles of the invention.
Figure 16:
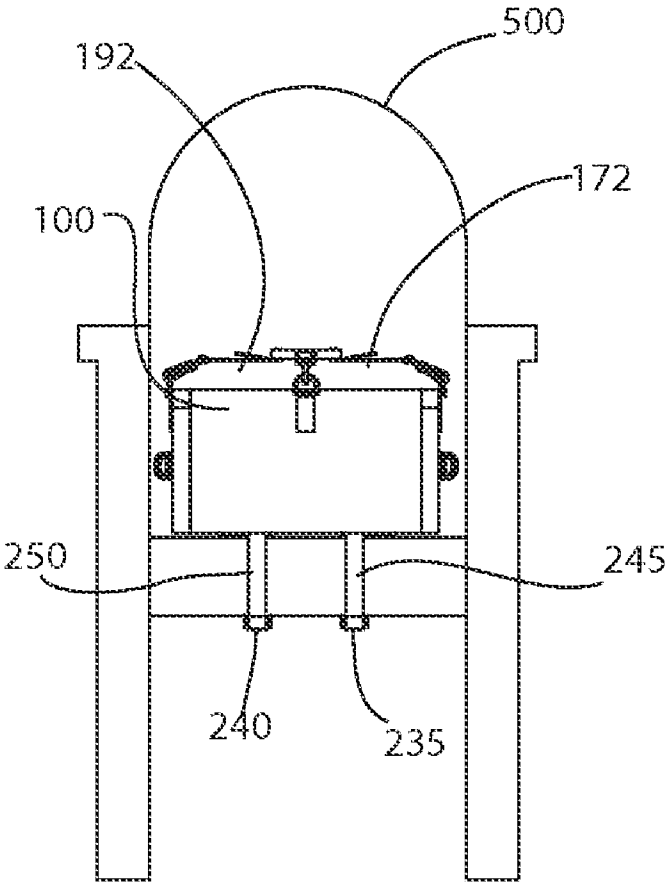
FIG. 16 is a front view of an exemplary booster seat on a theater-style seating apparatus according to principles of the invention.

The portions of the horizontal straps 170, 190 attached to the three point buckle 205 are referred to as the medial portions. The opposite end of each horizontal strap 170, 190 is referred to as the lateral portion or end. The portion of the vertical strap 185 that attaches to the three point buckle 205 is referred to as the superior portion. The opposite portion of the vertical strap 185 is referred to as the inferior portion or end. To allow adjustment, the opposite end (lateral, inferior end) of each of the straps, 170, 185, 190 may be adjustably connected to swivel spring clips 164, 180, 200. The swivel spring clips 164, 180, 200 connect to Dee-rings 162, 175, 195 attached to the adjacent panels using folded over webbing 161, 174, 194 stitched to the corresponding panel. Thus, the length of each strap 170, 185, 190 may be adjusted to accommodate children of various sizes. Attachment hardware other than swivel spring clips and Dee rings may be utilized to removably attach straps 170, 185, 190 to the housing 101, without departing from the scope of the invention. Dee ring 260 may also be used to orientate the harness, as shown in FIGS. 12 and 14.

In use, the back panel 131 is placed upon a seat. A child sits upon the front panel 130. When sitting, the child's legs extend towards the bottom panel 126 through the belt (i.e., lap belt)

formed by straps 170, 190. One leg extends on one side of strap 185, while the other leg extends on the opposite side of strap 185. Strap 185 is a pelvic strap, which passes between the legs and prevents a child from sliding forward off the seat.

A zippered closure extends across the top panel 125, from the top of the right panel 140 to the top of the left panel 141. The zippered closure 120 provides access to the cushion 102 contained within the housing 101. A closure other than zippers may be utilized without departing from the scope of the invention. Additionally, the closure may be located on panels other than the top panel 125 without departing from the scope of the invention.

The foam cushion 102 is a body supporting component comprising a foam core contained in the housing 101. It has a shape and volume similar to the housing 101, but may require compression to fit within the housing 101. The foam cushion 102 is a resilient open-celled (or closed cell) foam composed of polyurethane or a similar material. Preferably, a low density foam is employed, which exhibits a density of 1-4 pounds per cubic foot and an indentation force deflection (IFD) of 18-65 when the foam is uncompressed. A single piece of foam may be used. Alternatively, in certain embodiments, the foam core may include a plurality of adjacent pieces such as generally planar or ribbed upper and lower segments, which may be interlocked or adhered in some other suitable manner. In such versions, the respective pieces may have different densities and IFD ratings. This permits the user to initially provide a core with at least two different comfort, body support levels that may be subsequently adjusted in the manner described below. In alternative embodiments separate foam core segments having different densities and IFD ratings may be arranged side-by-side and extend either laterally or longitudinally within cover 101. These components may be either directly interengaged or separated by one or more dividing walls made of flexible plastic material so that each chamber may be pressure adjusted respectively without affecting other foam components within the core.

Optionally, the foam core 102 may be encased in or covered with a waterproof or water resistant bag or pad or covered with an absorbent disposable pad. Thus, any leakage through the housing 101 will be absorbed by or deflected by the pad or bag, thereby protecting the foam core.

A removable adjustable carrying strap 105 is releasably connected to the housing 101. In a preferred embodiment, Dee rings 155, 165 are provided near the top of each of the right and left side panels 140, 141. Each Dee ring 155, 165 may be attached to its respective panel using a strip of folded over and stitched webbing 156, 166. Swivel spring clips 150, 160 are provided at the ends of the carrying strap 105 for attaching the carrying strap 105 to the Dee rings 155, 165. One or more sliders 115 (e.g., a tri-glide slider or ladder buckle) is provided to facilitate adjusting the length of the shoulder strap by increasing or decreasing the portion of the strap 105 folded over in a loop formation. Attachment hardware other than swivel spring clips and Dee rings may be utilized to removably attach the shoulder strap to the housing 101, without departing from the scope of the invention.

Figure 11:
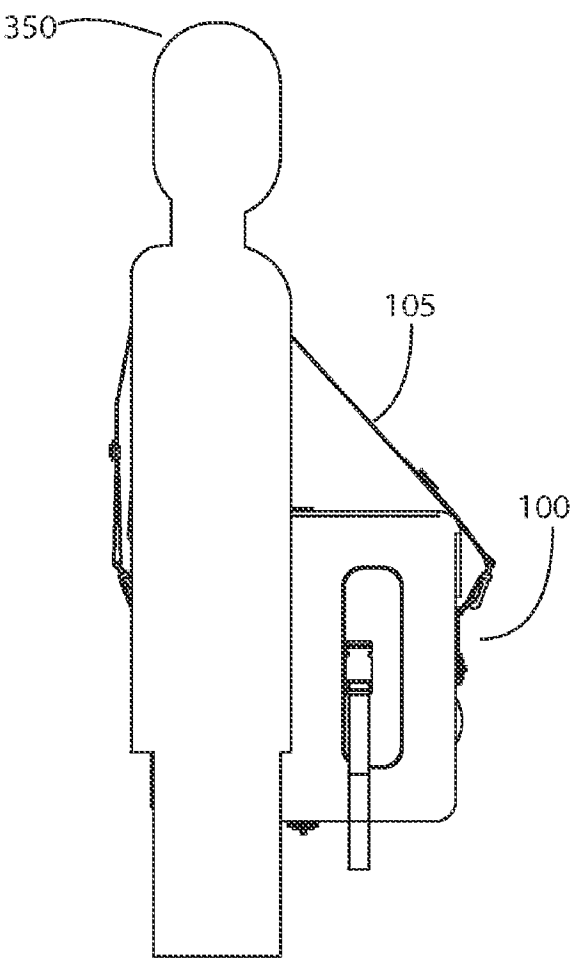
FIG. 11 is a second side schematic of an adult carrying a booster seat according to principles of the invention.
Figure 10:
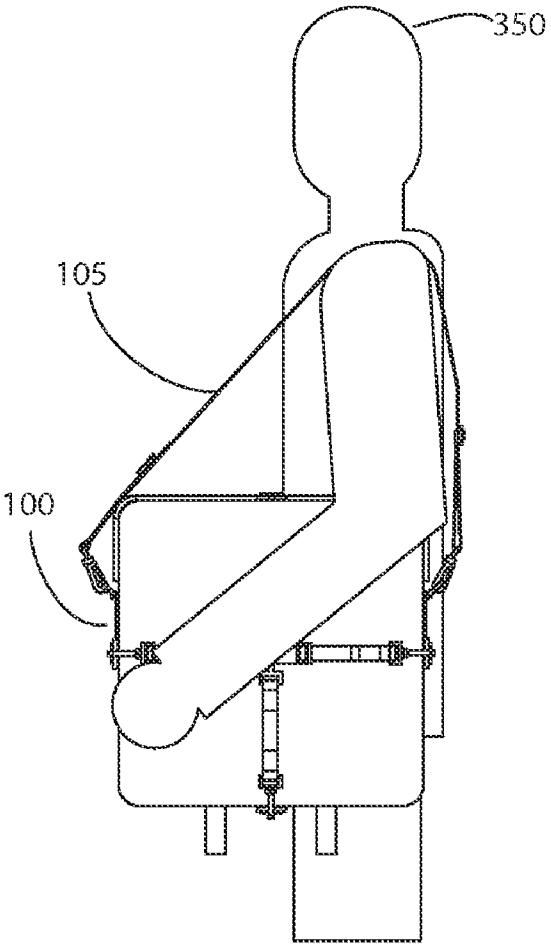
FIG. 10 is a first side schematic of an adult carrying a booster seat according to principles of the invention.

The carrying strap 105 enables use as a shoulder strap as shown in FIGS. 10 and 11. Thus, a child or adult 350 may sling the bag 100 over their shoulder to conveniently transport it. When the strap 105 is not in use, it may be removed.

Figure 9:
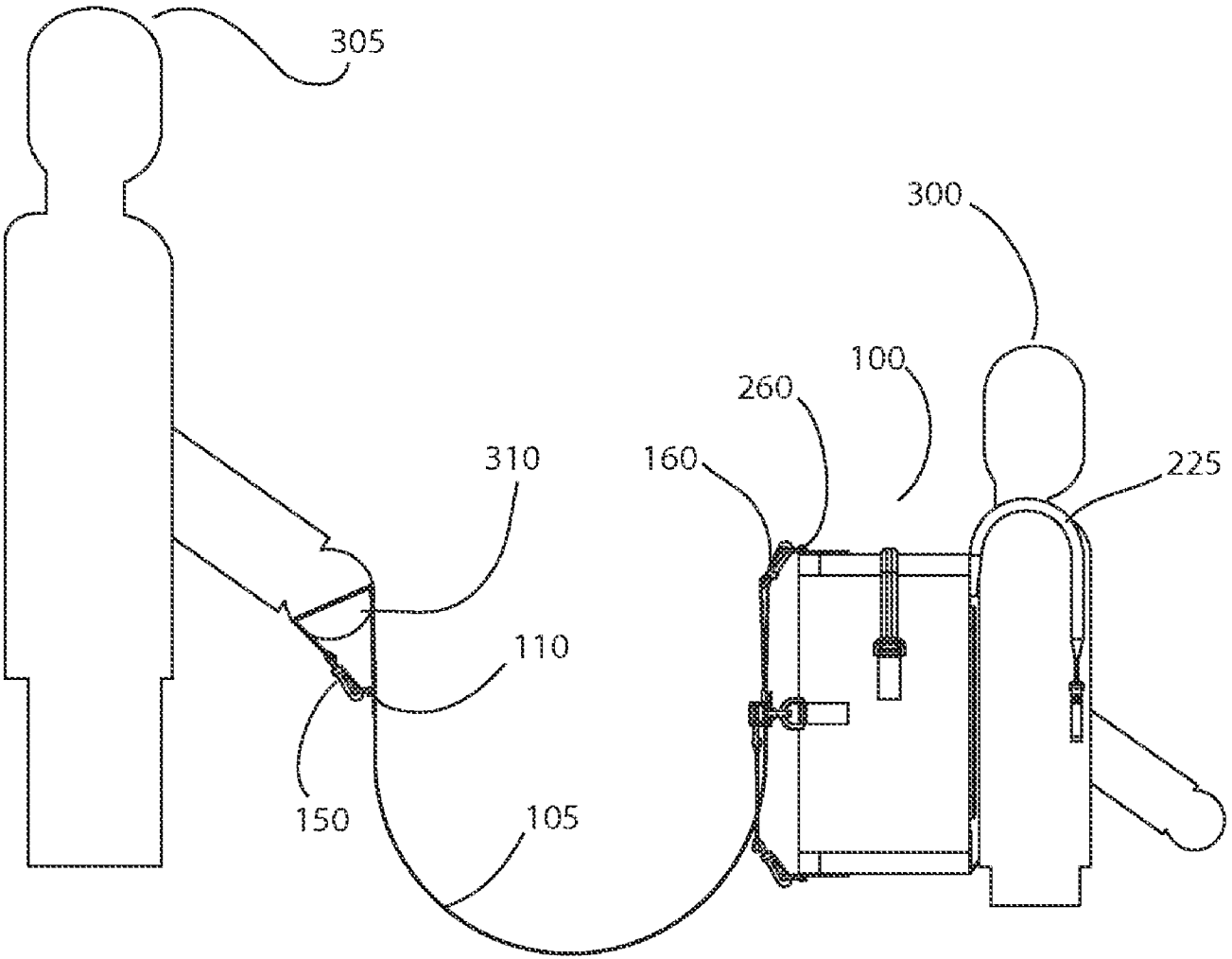
FIG. 9 is a schematic of an adult leashed to a child wearing a booster seat according to principles of the invention.

Uniquely, the exemplary carrying strap 105 may be transformed into a leash. The strap 105 includes a Dee-ring 110, somewhere between the ends of the strap 105, preferably spaced apart from the swivel spring clip 150 a sufficient distance to form a loop when the spring clip 150 is attached to the Dee-ring 110. The loop comprises a handle. The opposite spring clip 160 may be attached to a Dee-ring 260 attached to the housing 101. When attached in this manner, the carrying strap 105 is transformed into a leash with a handle 310, as shown in FIG. 9. Thus an adult 305 may maintain control of a child 300 wearing the seat over the child's shoulders, like a backpack.

A pair of parallel adjustable shoulder straps are provided for backpack-style carrying. The pair of straps includes padded shoulder strap portions 225, 230 near the top, which are releasably attached to webbing 245, 250, aka bottom straps, at the bottom. Length adjustable buckles 235, 240 (e.g., side release buckles) are provided to releasably and securely join the webbing bottom portion of the shoulder straps to the padded top portion of the shoulder straps. Length may be adjusted by adjusting the length of webbing fed through a portion (e.g., a ladder lock portion) of the buckle.

Figure 13:
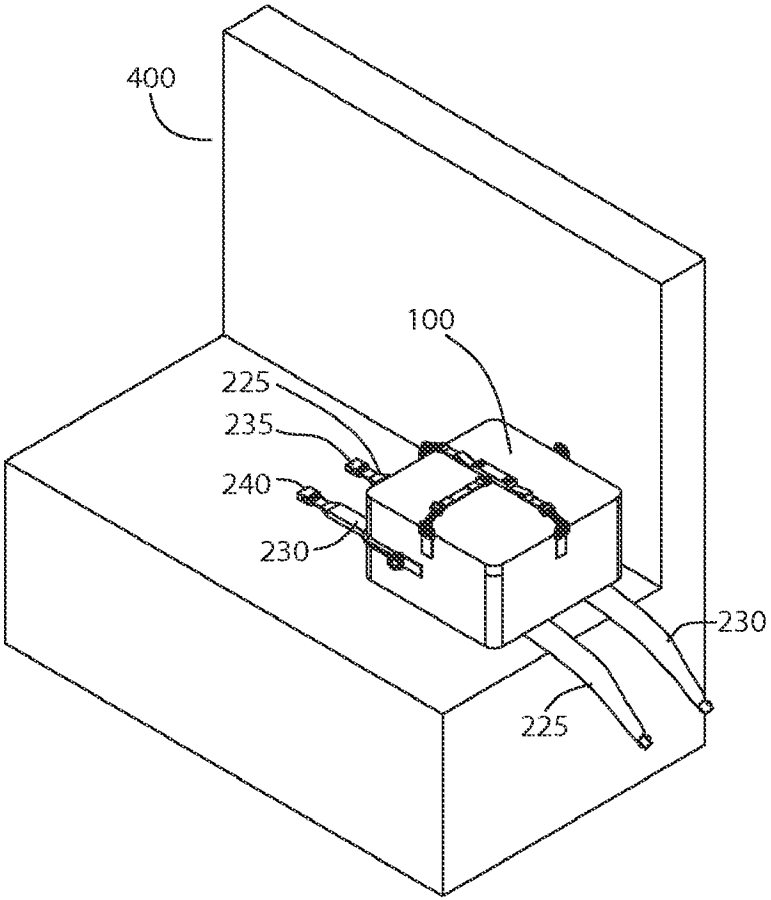
FIG. 13 is a second top perspective view of an exemplary booster seat on a bench-style seating apparatus according to principles of the invention.

The backpack style straps allow use as a backpack when carrying the booster seat. The releasable buckles 235, 240 allow reconfiguration, which enables laying the booster seat flat when used as a seat. When joined, the straps may be worn around a person's shoulders to carry the booster seat 100 in a backpack style. When the seat is placed on a seating surface, the buckles may be opened, and the bottom and top straps may be separated. The bottom straps 245, 250 may be folded and extended towards the bottom panel, and the top padded portions 225, 230 may be folded extended toward the top panel 125. In this manner, when the booster seat 100 is placed on a bench style seat 400, the straps do not have to be trapped between the seat and backpack, as shown in FIGS. 12 and 13. The extended straps may be folded or bunched alongside the booster seat. Alternatively, one or both portions of one or both straps may be left underneath the cushioned booster seat 100, during use.

Alternatively, the backpack style straps may be wrapped around the seat of a chair. For example, the straps may be wrapped around the seat of an ordinary chair, or a theater or stadium seat, as illustrated in FIGS. 14 through 17. In such case, the straps prevent the booster seat 100 from slipping off the chair.

The back panel 131 includes at least one non-slip pad 265, 270. In an exemplary embodiment two pads 265, 270 are shown. One edge of each pad 265, 270 is approximately aligned with the medial edge of each shoulder strap. The opposite edge of each pad extends beyond the opposite edge of each shoulder strap. Thus, each pad is wider than each shoulder strap. Each pad is approximately ½ to ⅔ the height of the back panel 131, and preferably centered between the top and bottom panels 125, 126. The pad may between a thin film and ¼ inch thick. However, other non-slip pad configurations may be used without departing from the scope of the invention.

The pads 265, 270 serve several purposes. First, they improve traction, preventing slipping of the booster seat on slick surfaces. Second, the pads provided added comfort during backpack-style use. The pads help maintain a space between a wearer's back and the housing 101 for enhanced breathability.

The pads may be comprised of any plastic or elastomeric non-slip material. The non-slip material 265, 270 can be any material that provides a coefficient of friction such that the seat 100 moves very little, if at all, under typical conditions of use, which includes normal lateral, translational forces applied simultaneously to the seat. Or stated another way, the sliding coefficient of friction between the non-slip material 265, 270 and the surface that the non-slip material is positioned on is preferably of a large enough value that the non-slip material moves at most very little, if at all, in response to the non-normal, lateral, translational forces applied under typical conditions of use. Non-limiting examples of preferred non-slip material 265, 270 are: a natural and/or synthetic rubber material, an elastomeric rubber material, a polymeric foamed solid (e.g., neoprene); a foamed rubber; another flocked surface; a polychoroprene or a mixture of one or more thereof.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A booster seat comprising:

a removable body-supporting cushion;

a housing that defines a compartment for containing the removable body-supporting cushion, the housing comprising a front panel, a back panel having a back panel height and a back panel width and four side panels connecting the front panel to the back panel, said four side panels comprising a top panel, a bottom panel, a left side panel and a right side panel, said housing having an exterior surface, said front panel, back panel, and four side panels being comprised of pliable material;

an opening with a releasable closure along at least one of said four side panels, allowing access to the compartment;

a pair of parallel adjustable shoulder straps configured for backpack-style carrying, each adjustable strap of the pair of parallel adjustable straps having a top end and a bottom end, the bottom end being attached to the back panel adjacent to the top panel and the bottom end being attached to the back panel adjacent to the bottom panel, one adjustable strap defining a loop through which one arm and one shoulder may extend, the other adjustable strap defining a loop through which another arm and another shoulder may extend; and a pair of non-slip pads, one of the pair of non-slip pads being attached to the back panel between the back panel and one adjustable strap of the pair of adjustable shoulder straps, the other of the pair of non-slip pads being attached to the back panel between the back panel and the other adjustable strap of the pair of adjustable shoulder straps, and the pair of non-slip pads being substantially parallel and spaced apart, and the height of each of the pair of non-slip pads being less than the back panel height of the back panel, and the width of each of the pair of non-slip pads being less than one half of the back panel width of the back panel;

a three-point seat belt, said three point seat belt including a seat belt buckle and a T-shaped arrangement of three seat belt straps disposed on the front panel of the housing, each of two of said three seat belt straps having a medial end and an opposite lateral end, and one of said three seat belt straps having a superior end and an inferior end;

each medial end and the superior end of the three seat belt straps being attached to the seat belt buckle, and each of the lateral ends and inferior end of the seat belt straps being coupled to one of a first snap swivel, second snap swivel and third snap swivel, and each of the first snap swivel, second snap swivel and third snap swivel being releasably coupled to the housing; the first seat belt strap extending from the seat belt buckle to the first snap swivel adjacent to the first side edge of the front panel, and the second seat belt strap extending from the seat belt buckle to the second snap swivel adjacent to the second side edge of the front panel opposite the first side edge, and the third seat belt strap extending from the seat belt buckle in a direction perpendicular to the bottom side edge of the front panel to the third snap swivel, said first and second seat belt straps defining a lap belt and the third seat belt strap defining a pelvic belt.

2. A booster seat according to claim 1, the body-supporting cushion comprising a polyurethane foam core.

3. A booster seat according to claim 2, the body-supporting cushion further comprising a waterproof cover over the polyurethane foam core.

4. A booster seat according to claim 2, the body-supporting cushion further comprising an absorbent cover over the polyurethane foam core.

5. A booster seat according to claim 1, each adjustable strap of the pair of parallel adjustable straps comprising an upper padded shoulder strap portion and a lower webbing portion, and a releasable buckle releasably joining the upper padded shoulder strap portion to the lower webbing portion.

6. A booster seat according to claim 5, each releasable buckle being a length adjustable buckle, an adjustable segment of the lower webbing portion of each adjustable strap being threaded through and retained by the length adjustable buckle.

7. A booster seat according to claim 5, each releasable buckle being a length adjustable buckle comprising a releasable buckle with a ladder lock portion, the ladder lock portion receiving an adjustable segment of the lower webbing portion of each adjustable strap being threaded through and retained by the length adjustable buckle.

8. A booster seat according to claim 7, each of the pair of parallel adjustable shoulder straps being adjustable in length to extend across the bottom of a seat of a seating apparatus while the booster seat rests on top of the seat, and each releasable buckle being configured to enable each upper padded shoulder strap portion to detach from each lower webbing portion, allowing reattachment under the bottom of the seat using the releasable buckle.

9. A booster seat according to claim 8, further comprising a removable carrying strap having a first end and a second end, the first end being releasably coupled to one of the four side panels of the housing and the second end being releasably coupled to an opposite side of the four side panels of the housing.

10. A booster seat according to claim 9, further comprising a removable adjustable length carrying strap having a first end and a second end, a first releasable coupling attached to the first end, a second releasable coupling attached to the second end, the second end including an adjustable length looped portion, the first end being releasably coupled, using the first releasable coupling, to one of the four side panels of the housing and the second end being releasably coupled, using the second releasable coupling, to an opposite side panel of the four side panels of the housing, and an intermediate coupling attached to the strap between the first end and the second end, said first releasable coupling being attachable to the intermediate coupling to form a loop handle at the first end of the strap.

11. A booster seat according to claim 10, further comprising a removable adjustable length carrying strap having a first end and a second end, a first releasable coupling attached to the first end, a second releasable coupling attached to the second end, the second end including an adjustable length looped portion, the first end being releasably coupled, using the first releasable coupling, to one of the four side panels of the housing and the second end being releasably coupled, using the second releasable coupling, to an opposite side panel of the four side panels of the housing, and an intermediate coupling attached to the strap between the first end and the second end, said first releasable coupling being attachable to the intermediate coupling to form a loop handle at the first end of the strap, and a leash coupling attached to the housing at the top panel, said second end of said removable adjustable length carrying strap being attachable to the leash coupling using the second releasable coupling.

12. A booster seat according to claim 11, further said seat belt buckle comprising an integral seat belt buckle comprising a lateral member having a first lateral end and a second lateral end opposite the first lateral end, and an integral bisecting member perpendicular to the lateral member and bisecting the lateral member at a superior end and having an inferior end opposite the superior end, and each of the lateral and bisecting members having a longitudinal axis, and the lateral member including a first slot adjacent to the first lateral end, perpendicular to the longitudinal axis of the lateral member and sized to receive the medial end of one of the seat belt straps, and the lateral member including a second slot adjacent to the second lateral end, perpendicular to the longitudinal axis of the lateral member and sized to receive the medial end of another one of the seat belt straps, and the bisecting member including a third slot adjacent to the inferior end, perpendicular to the longitudinal axis of the lateral member, and sized to receive a superior end of one of the seat belt straps.

13. A booster seat according to claim 1, each of said pair of non-slip pads being about 0.125 to 0.250 inches thick.

* * * * *